US008074299B2

(12) United States Patent
Brookman

(10) Patent No.: US 8,074,299 B2
(45) Date of Patent: Dec. 13, 2011

(54) PROTECTIVE ENSEMBLE

(75) Inventor: Michael J. Brookman, Branford, CT (US)

(73) Assignee: Interspiro, Inc., Pleasant Prairie, WI (US)

( * ) Notice: Subject to any disclaimer, the term of this patent is extended or adjusted under 35 U.S.C. 154(b) by 1246 days.

(21) Appl. No.: 11/675,481

(22) Filed: Feb. 15, 2007

(65) Prior Publication Data

US 2011/0094020 A1 Apr. 28, 2011

Related U.S. Application Data

(63) Continuation-in-part of application No. 10/412,469, filed on Apr. 9, 2003, now abandoned.

(60) Provisional application No. 60/371,988, filed on Apr. 10, 2002.

(51) Int. Cl.
*A41D 13/00* (2006.01)
*A41D 13/02* (2006.01)
*A41D 27/00* (2006.01)

(52) U.S. Cl. ..... 2/243.1; 2/455; 2/456; 2/79; 2/82; 2/265

(58) Field of Classification Search ..... None
See application file for complete search history.

(56) References Cited

U.S. PATENT DOCUMENTS 1,773,019 A * 8/1930 Wickers ..... 222/90
2,237,860 A * 4/1941 Bolle ..... 368/289
3,680,556 A * 8/1972 Morgan ..... 128/201.15
3,695,262 A * 10/1972 Haviland ..... 128/201.28
3,889,297 A * 6/1975 Jarboe et al. ..... 2/16
3,943,571 A * 3/1976 Boatman ..... 2/421
3,955,570 A * 5/1976 Hutter, III ..... 128/201.23
4,136,402 A * 1/1979 Insulan et al. ..... 2/2.15
4,227,262 A * 10/1980 Insulan et al. ..... 2/2.16
4,266,301 A * 5/1981 Canda ..... 2/410
4,352,353 A * 10/1982 Bolton et al. ..... 128/201.24
4,470,515 A * 9/1984 Boehm ..... 220/316
4,510,193 A 4/1985 Blucher et al.
4,612,239 A 9/1986 Dimanshteyn
4,622,696 A * 11/1986 Griffiths ..... 2/6.3
4,637,383 A 1/1987 Lopez (Continued)

FOREIGN PATENT DOCUMENTS

FR 2 514 934 4/1983

(Continued)

OTHER PUBLICATIONS

"Approved Gas Masks—MSA Response NBC Escape Hood Hooded Gas Mask System for beards, glasses, executive escape," http://www.approvedgasmasks.com/msa-responder.htm (undated).

(Continued)

*Primary Examiner* — Bobby Muromoto, Jr.
(74) *Attorney, Agent, or Firm* — Marshall, Gerstein & Borun LLP

(57) ABSTRACT

A protective bodysuit comprises a body portion and a hood portion that are selectively securable together via a zipper along a sealing interface. The body portion and the hood portion are constructed of a material for protecting a wearer against chemical, biological, radiological, nuclear, and/or fire hazards. Additionally, the protective bodysuit comprises a sealing apparatus that is removably coupled between opposing ends of the zipper to provide a complete seal between the hood portion and the body portion.

27 Claims, 7 Drawing Sheets

U.S. PATENT DOCUMENTS

| | | | | | |
|---|---|---|---|---|---|
| 4,864,654 | A | * | 9/1989 | Schriver et al. | 2/84 |
| 4,872,220 | A | * | 10/1989 | Haruvy et al. | 2/243.1 |
| 4,932,078 | A | * | 6/1990 | Jones et al. | 2/70 |
| 4,932,399 | A | * | 6/1990 | Cappa et al. | 128/202.27 |
| H823 | H | | 10/1990 | Conkle et al. | |
| H863 | H | * | 1/1991 | Kwiedorowicz et al. | 2/424 |
| 5,109,549 | A | | 5/1992 | Mattinson et al. | |
| 5,112,666 | A | | 5/1992 | Langston et al. | |
| 5,115,804 | A | * | 5/1992 | Brookman | 128/201.22 |
| 5,221,572 | A | | 6/1993 | Meunier et al. | |
| 5,274,850 | A | | 1/1994 | Aldridge | |
| 5,386,616 | A | | 2/1995 | Norvell | |
| 5,441,168 | A | * | 8/1995 | Carlini | 220/378 |
| 5,452,712 | A | * | 9/1995 | Richardson | 128/201.25 |
| 5,540,218 | A | * | 7/1996 | Jones et al. | 128/201.24 |
| 5,626,947 | A | | 5/1997 | Hauer et al. | |
| 5,628,065 | A | * | 5/1997 | Austin | 2/81 |
| 5,653,225 | A | * | 8/1997 | Schegerin | 128/201.24 |
| 5,743,775 | A | | 4/1998 | Baurmeister et al. | |
| 5,991,921 | A | | 11/1999 | Saito et al. | |
| 6,006,360 | A | * | 12/1999 | Reed | 2/202 |
| 6,038,700 | A | * | 3/2000 | Aldridge et al. | 2/81 |
| 6,328,031 | B1 | * | 12/2001 | Tischer et al. | 128/201.25 |
| 6,340,024 | B1 | * | 1/2002 | Brookman et al. | 128/201.25 |
| 6,478,025 | B1 | * | 11/2002 | Yort et al. | 128/201.25 |
| 6,578,572 | B2 | * | 6/2003 | Tischer et al. | 128/201.25 |
| 6,763,835 | B1 | * | 7/2004 | Grove et al. | 128/857 |
| 6,775,850 | B1 | * | 8/2004 | Grilliot et al. | 2/424 |
| 6,829,784 | B2 | | 12/2004 | Austin | |
| 6,889,390 | B1 | * | 5/2005 | Morgan et al. | 2/202 |
| 7,051,374 | B1 | * | 5/2006 | Grilliot et al. | 2/69 |
| 7,631,364 | B2 | * | 12/2009 | Culler et al. | 2/2.17 |
| 7,650,885 | B2 | * | 1/2010 | Paoluccio et al. | 128/206.29 |
| 7,743,433 | B1 | * | 6/2010 | Grove et al. | 2/465 |
| 7,758,004 | B2 | * | 7/2010 | Brookman et al. | 248/311.3 |
| 2002/0046752 | A1 | * | 4/2002 | Tischer et al. | 128/201.29 |
| 2002/0124299 | A1 | * | 9/2002 | Malcolm | 2/439 |
| 2003/0005933 | A1 | * | 1/2003 | Izuchukwu | 128/205.22 |
| 2003/0070211 | A1 | * | 4/2003 | Crye et al. | 2/457 |
| 2003/0209241 | A1 | * | 11/2003 | Fournier et al. | 128/201.22 |
| 2003/0213050 | A1 | * | 11/2003 | Fournier | 2/424 |
| 2003/0213051 | A1 | * | 11/2003 | Fournier et al. | 2/424 |
| 2004/0003810 | A1 | * | 1/2004 | Templeton et al. | 128/201.22 |
| 2004/0060102 | A1 | * | 4/2004 | Brookman | 2/457 |
| 2005/0005970 | A1 | * | 1/2005 | Lundeberg et al. | 137/371 |
| 2005/0010996 | A1 | * | 1/2005 | Steinert | 2/458 |
| 2005/0011517 | A1 | * | 1/2005 | Steinert | 128/202.19 |
| 2005/0108801 | A1 | * | 5/2005 | Morgan et al. | 2/9 |
| 2005/0115567 | A1 | * | 6/2005 | Bridges et al. | 128/206.21 |
| 2005/0150496 | A1 | * | 7/2005 | Smaldone | 128/206.21 |
| 2005/0160514 | A1 | * | 7/2005 | Flaniken | 2/84 |
| 2005/0193472 | A1 | | 9/2005 | Courtney et al. | |
| 2005/0249917 | A1 | * | 11/2005 | Trentacosta et al. | 428/137 |
| 2005/0268907 | A1 | * | 12/2005 | McFarlane | 128/201.22 |
| 2005/0268914 | A1 | * | 12/2005 | Paoluccio et al. | 128/205.25 |
| 2006/0021118 | A1 | * | 2/2006 | Culler et al. | 2/457 |
| 2006/0048777 | A1 | * | 3/2006 | Brookman | 128/201.22 |
| 2006/0102177 | A1 | * | 5/2006 | Lewis et al. | 128/201.23 |
| 2006/0107448 | A1 | * | 5/2006 | Brookman | 2/457 |
| 2007/0044804 | A1 | * | 3/2007 | Matula et al. | 128/206.21 |
| 2007/0113846 | A1 | * | 5/2007 | Piorkowski et al. | 128/201.26 |
| 2007/0169247 | A1 | | 7/2007 | Mordecai et al. | |
| 2007/0175470 | A1 | * | 8/2007 | Brookman et al. | 128/200.23 |
| 2008/0216218 | A1 | * | 9/2008 | McKinney et al. | 2/457 |
| 2009/0262542 | A1 | * | 10/2009 | Li et al. | 362/373 |
| 2010/0287688 | A1 | * | 11/2010 | Stachler et al. | 2/424 |
| 2010/0288273 | A1 | * | 11/2010 | Sandlin | 128/201.24 |

FOREIGN PATENT DOCUMENTS

| | | |
|---|---|---|
| GB | 2 025 316 | 1/1980 |
| GB | 2 409 246 | 6/2005 |
| WO | WO-00/57738 | 10/2000 |
| WO | WO-03/086541 | 10/2003 |

OTHER PUBLICATIONS

"Bunker Gear: Firefighter Chicago Style Hood by Morning Pride," http://www.ilfireandpoliceequip.com/hood.htm (undated).

"Buy Gas Masks," http://www.technology-sourcing.com/gasmasks.html (undated).

"Emergency Escape Hood," http://www/spyshops.ca/emergencyescapehood.htm (undated).

"Escape Masks," http://store.yahoo.com/safetyproducts-store/escapemasks.html (undated).

"Escape Masks: Emergency mask: personal escape masks, smoke mask, smoke hood, bioterrorism, fire safety, chemical attack," http://www.escapemasks.com (undated).

"Evac-U8 Smoke Hood for fires," http://store.yahoo.com/emergencyoptions/evsmhoforfib.html (undated).

"Exitair Smoke Escaping Hoods—Specifications," http://www/exitairsmokehoods.com/prodin.html (undated).

"Exitair® Smoke Hoods," http://www.exitairsmokehoods.com/exsmokhood.html (undated).

"Fire Dex Hoods," http://www/firedex.com/products/firefighter_apparel/hoods/index/htm (undated).

"Fire-End Hoods," http://www/fire-end.com/hoods2.htm (undated).

"Gas Masks Chemical Protection," http://store.yahoo.com/battledressuniform/gasmasks.html (undated).

"Hot Shield USA—Hot Shield HS-2," http://www/hotshield.com/1/hotshield_hs2.htm (undated).

"I.B.N. Protection Products," http://www.ibnprotection.com/main-faq.html (undated).

"Kaptair inc. Exitair the smoke hood: mask for emergency evacuation in case of fire provides a better chance of suriving, protects lungs and head from smoke," http://www.raytechstore.com/msm/kaptair.htm (undated).

"NBC Escape masks from Survivair," http://www.americanairworks.com/quick2000/quick2000.html (undated).

"North® Emergency Escape Breathing Apparatus—10 Minute Unit," http://www.citizensafe.com/noremesbreat1.html (undated).

"Occupational Health & Safety Regulation," http://regulation.healthandsafetycenter.com/s/Part31.asp (undated).

"OPMD Fire Research and Development Group Fire Research News," Issue 19, http://www.safety.odpm.gov.uk/fire/fepd/frp/frn/frn19/09.htm (Summer 1995).

"PGI 'Web Threads' Directory," http://www.pgi-inc.com/ (undated).

"Products—Hoods," http://www.morningpride.com/products/structural/hoods/ (undated).

"Respiratory Protection: Draeger Escape Respirators," http://www.afcintl.com/resp7.htm (undated).

"Smoke Escaping Hoods," http://www.traveloasis.com/smokes-hood.html (undated).

"Ultimate Hood," http://www.firewear.com/hdcarb.htm (undated).

Air Force Civil Engineer Support Agency A-Gram Newsletter, "Proximity Fire Fighting Helmet," 95-16 (Apr. 1995).

Partial International Search report for corresponding International Application No. PCT/US2008/053931 (dated Dec. 2, 2008).

International Search Report and Written Opinion for corresponding International Application No. PCT/US2008/053931 (dated Mar. 31, 2009).

* cited by examiner

PROTECTIVE ENSEMBLE

CROSS-REFERENCE TO RELATED APPLICATIONS

This application is a continuation-in-part of U.S. application Ser. No. 10/412,469, filed Apr. 9, 2003, which claims the benefit of U.S. Provisional Application No. 60/371,988, filed Apr. 10, 2002, each of which are hereby incorporated herein by reference in their entirety.

BACKGROUND OF THE INVENTION

As a result of recent terrorist attacks, there has been a heightened concern for the protection of first-response personnel. When entering these disaster sites, first-response personnel may be presented with both fire hazards and biological and chemical hazards. These biological and chemical hazards may come in the form of chemical warfare agents or as a result of the devastation of a disaster area. For example, at the terrorist attacks at the World Trade Center in New York City on Sep. 11, 2001, the combination of the intense heat from the fires and the collapsing of the two 110-story buildings increased the likelihood of an asbestos contamination.

First-response personnel protective gear currently comes as firefighter suits or fully encapsulated chemical protective suits. Firefighter suits do not satisfy the aforementioned dangers because they lack the protection from biological and chemical hazards. Fully encapsulated chemical protective suits do not satisfy the aforementioned dangers because they lack protection from fire hazards. Chemical protective suits are also bulky, which minimizes a first-responder's ability to assist those in need.

Military personnel also lack proper protection during military missions from attacks involving biological, chemical, radiological, nuclear, and fire hazards. Like first-response personnel, mobility may be crucial in escaping from such hazards to save their lives and the lives of others. In current chemical protective suits, military personnel need to concern themselves with sudden and sharp movements that may tear their suits, thus eliminating their protective purpose.

Improvements to first-response protective gear are desirable to alleviate these and other drawbacks. Accordingly, new first-response protective gear are provided.

SUMMARY

This disclosure relates generally to headgear and/or a bodysuit for first-response personnel, like firefighters, who rush into biological, chemical, radiological, nuclear, and fire hazard areas immediately after such events occur. In particular, one embodiment of the disclosure relates to a hood, such as a balaclava-shaped hood integrated with a protective mask, that may provide biological, chemical, radiological, nuclear, and fire protection to first-response personnel.

The hood may be balaclava-shaped and may include distinct layers of protection from the different hazards faced by a first-response personnel. An inner layer may be comprised of a stretchable fabric. A middle layer may be comprised of carbon spheres which absorb a biological or chemical agent and may provide an adsorptive barrier to chemicals before it reaches the inner layer. Alternatively, the middle layer may be comprised of a blocking agent that blocks transmission of biological or chemical agents through the layer. An outer layer may be comprised of a fiber-product that has flame-resistant properties. An example of such a product is Dupont's NOMEX®.

Persons skilled in the art will appreciate that the principles of the present disclosure may be used to construct different apparel, such as, but not limited to, a shirt, pair of pants, glove, sock, jacket, hat, and blanket.

For example, another embodiment of the present disclosure includes a bodysuit for protecting first-response personnel from chemical, biological, radiological, nuclear, and fire hazards. Such a bodysuit may include a body portion and a hood portion, which may otherwise be referred to as a frill. The bodysuit may or may not be constructed of the aforementioned multi-layered material, nut nonetheless provides the aforementioned protections. In one embodiment, the hood portion is releasably sealed and secured to the body portion with a fluid-tight zipper assembly or other such user-manipulable securing and sealing device. Additionally, a supplemental sealing apparatus is provided between the abutting zipper ends to complete the seal. For example, upon closure of the zipper assembly, a slight opening may exist between an end of the zipper tape and the slider of the zipper assembly. Accordingly, in one embodiment, the supplemental sealing apparatus comprises a stem and a pair of opposing circular clam shells. The stem is disposed within the opening in the zipper and the clam shells are secured to the stem. The stem compresses circumferential portions of the opposing clam shells together about the opening to thereby seal the opening.

DETAILED DESCRIPTION OF THE INVENTION

Current outerwear worn by first-response personnel, such as firefighters, is designed to protect them from heat, flame, and impact injuries. These first-responders, however, do not have adequate protection from the biological and chemical hazards that may also be present at the fire or disaster site. At present, the only protection from biological and chemical hazards are fully encapsulated biohazard suits, such as suit 102 shown in FIG. 1. These suits, however, may not be practical for disaster applications because: (1) they are vulnerable to flames and intense heat; and (2) they may not provide first-responders with the necessary protection against impact injuries. This is problematic, particularly in view of recent terrorist attacks in which materials, such as asbestos, may be present. Thus, a need has arisen for additional protection, such as from chemical hazards, when first-responders approach disaster sites.

Figure 1:
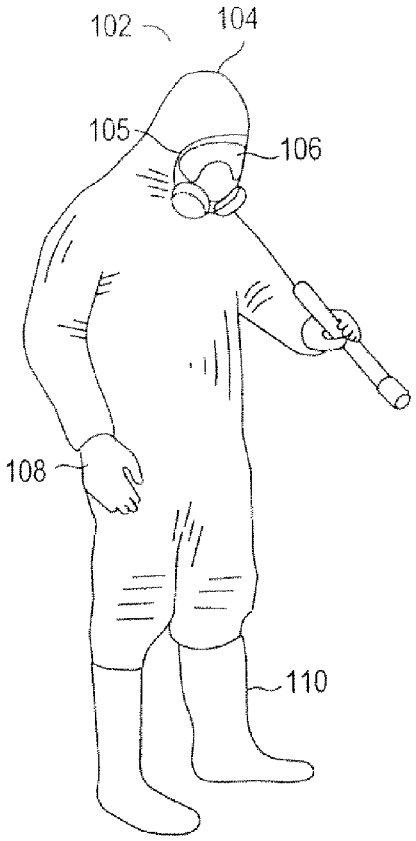
FIG. 1 PRIOR ART
FIG. 1 shows an illustration of a known fully encapsulated chemical protective suit.

FIG. 1 shows an illustration of a known fully encapsulated chemical protective suit 102. Fully encapsulated suit 102 may be comprised of hood 104, mask 106, gloves 108, and boots 110. Openings, or interfaces, that may exist between the different parts of suit 102 may be protected from chemicals by, for example, using sealing tape. Interface 105 between hood 104 and mask 106 may be sealed with tape or alternatively cinched to effect a seal. Fully encapsulated suit 102, however, may be ineffective for first-response personnel because it is likely to be more vulnerable to hazards associated with firefighting, such as flames, intense heat and impact injuries than traditional firefighting gear. Moreover, fully encapsulated suit 102 may not provide first-responders with the dexterity necessary to sufficiently deal with the chaos that is often found in disaster areas because of its bulk and operating limitations.

One area of the body that may be particularly susceptible to biological and chemical hazards is the cranial, or head region. While this region is likely the most critical for cutaneous protection, it is also the most difficult to efficiently and effectively protect because it is the most dynamic for the personnel responding to the fire or disaster area in terms of the relative movement of the torso, head, and neck.

Figure 2:
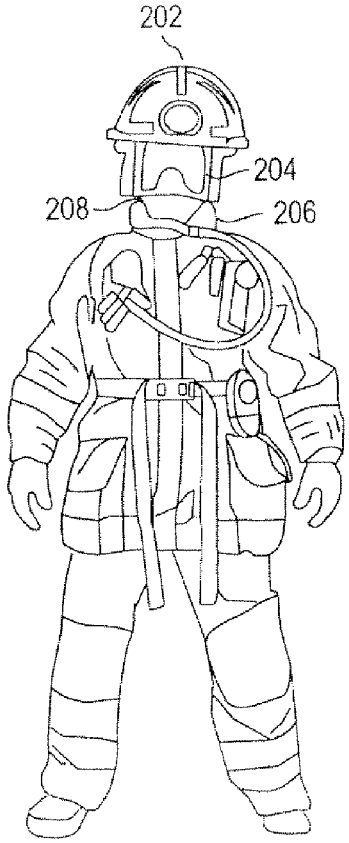
FIG .2 PRIOR ART
FIG. 2 shows an illustration of firefighter outerwear typically worn by firefighters.

FIG. 2 shows an illustration of firefighter outerwear 202 presently used for protection of emergency personnel. Firefighter outerwear 202 may include mask 204 and coat collar 206. Interface 208 between mask 204 and coat collar 206 may be sealed using sealing tape to protect parts of the body exposed at this interface.

In addition to sealing interface 208 with sealing tape, one might seal interface 208 with a zipper, buttons, by sewing, or other sealing means. Each of these sealing means is ineffective because openings, even if these openings are small, exist and leave first-response personnel susceptible to biological, chemical, radiological, nuclear, and even possibly fire hazards.

Figure 3:
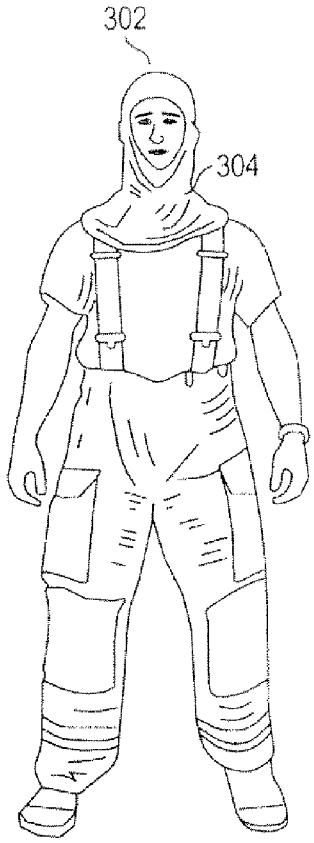
FIG. 3 PRIOR ART
FIG. 3 shows an illustration of the undergarments typically worn by firefighters.

FIG. 3 shows an illustration of firefighter under-garments 302 that are presently used for protection by firefighters. Under-garments 302 are often used in conjunction with outerwear 202. Firefighter undergarments 302 may include flame-resistant hood 304 to further protect the body, especially in areas left fully or partially exposed by outerwear 202, and especially by interface 208. Despite using flame-resistant hood 304, mask 204, coat collar 206 and sealing tape, a firefighter may still be vulnerable to biological and chemical hazards because the safeguards shown in FIGS. 2 and 3 are not designed to protect these personnel from such hazards.

Figure 4:
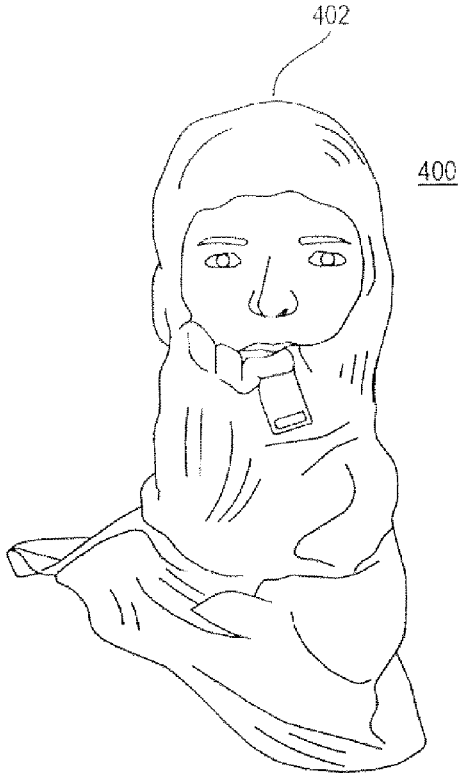
FIG. 4 shows an illustration of a frontal view of a hood that provides first-response personnel with protection from biological, chemical, radiological, nuclear, and fire hazards in accordance with the principles of the present invention.
Figure 5A:
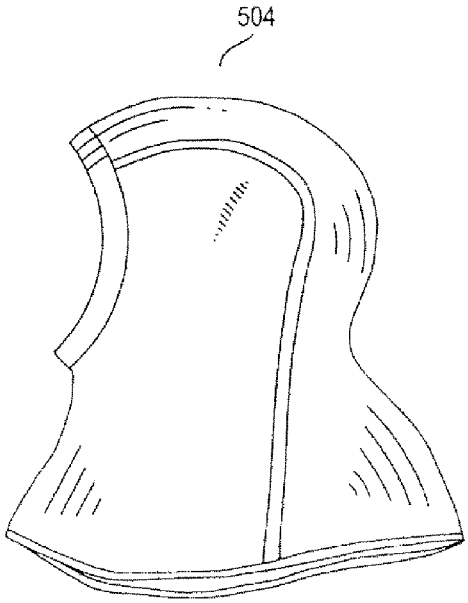
FIG. 5*a* shows an illustration of a profile view of a hood that provides first-response personnel with protection from biological, chemical, radiological, nuclear, and fire hazards in accordance with the principles of the present invention.

One embodiment relates to a hood that provides first-response personnel with protection from biological, chemical, radiological, nuclear, and fire hazards in the cranial region. FIGS. 4 and 5*a* show illustrations of a balaclava-shaped hood 400 including frontal view 402 and profile view 504, respectively. The balaclava-shaped hood, when integrated with a protective mask, provides covering and protection to the head, face, neck and parts of the chest, back, and shoulders while still allowing openings for the personnel to breathe and see.

Figure 5B:
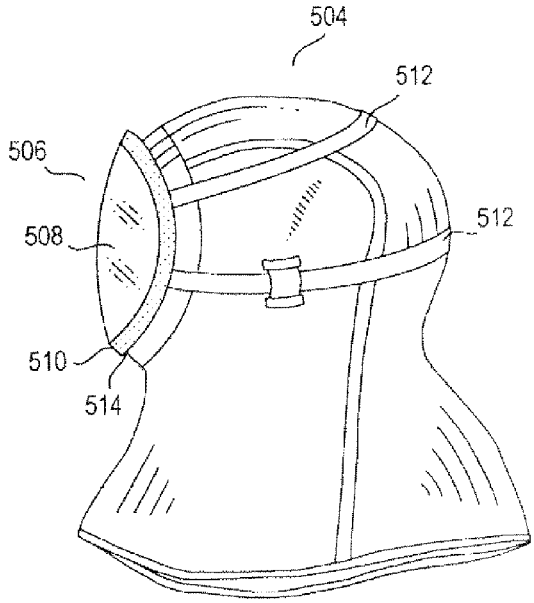
FIG. 5*b* shows an illustration of a profile view of a hood integrated with a protective mask that provides first-response personnel with protection from biological, chemical, radiological, nuclear, and fire hazards in accordance with the principles of the present invention.

FIG. 5*b* shows illustrative profile view 504 of a balaclava-shaped hood 400 integrated with protective mask 506. Protective mask 506 may include mask lens 508, lens frame 510, and straps 512. Protective mask 506 may provide first-response personnel with protection from biological, chemical, radiological, nuclear, and fire hazards. Openings, or interfaces, that may exist between balaclava-shaped hood 400 and protective mask 506 may be protected from biological, chemical, radiological, nuclear, and fire hazards by, for example, using sealing tape. Interface 514 between mask 508 and hood 400 may be cinched to create a seal, sealed with tape, hook and loop fasteners, snaps, buttons, zippers, by sewing, or other sealing means.

Figure 6:
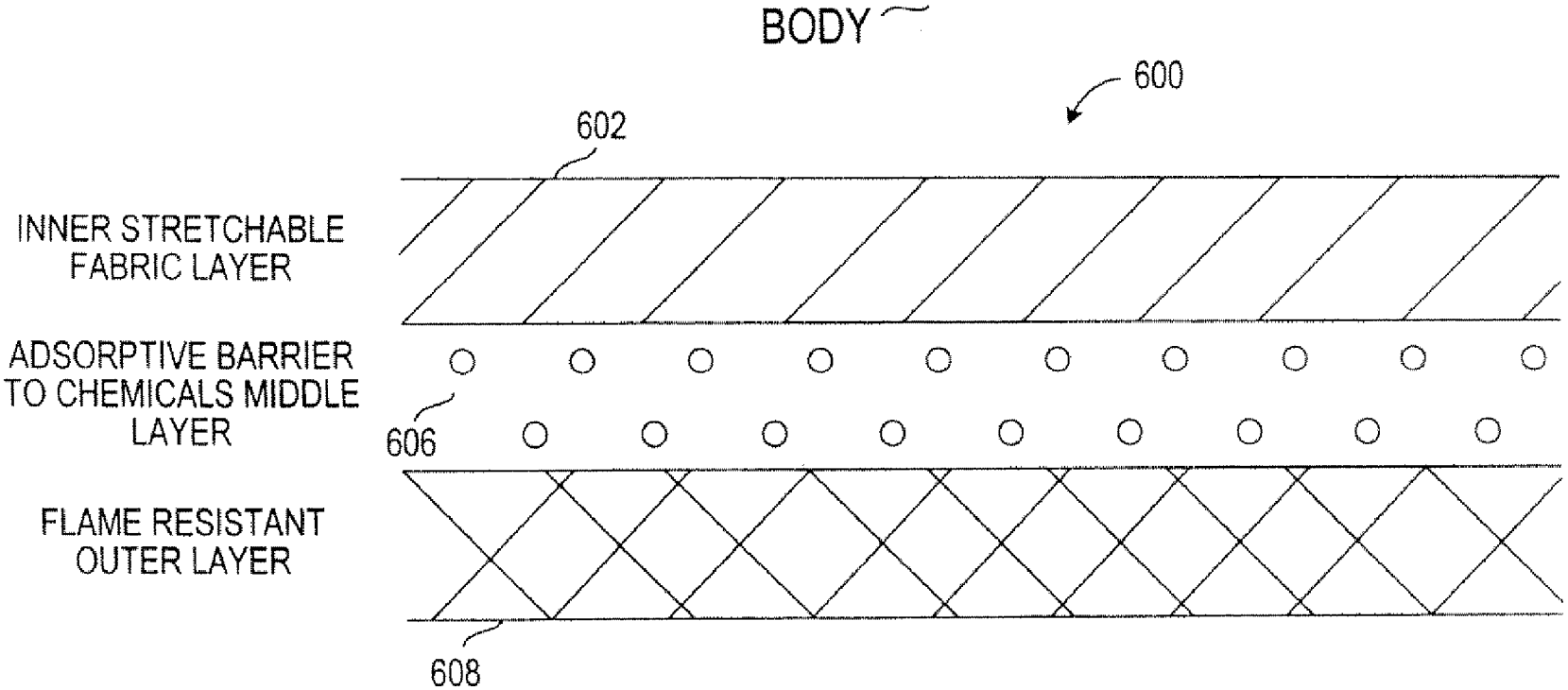
FIG. 6 shows an illustrative cross-sectional view of the protective hood of FIGS. 4 and 5 constructed in accordance with the principles of the present invention.

FIG. 6 shows an illustrative cross-sectional view of the composition 600 of hood 400 constructed in accordance with the present invention that provides protection from biological, chemical, radiological, nuclear, and fire hazards. Hood 400 may be balaclava-shaped and may include inner layer 602, middle layer 606 and outer layer 608. Inner layer 602 may be flush with body 604 (i.e., the body of the first-response personnel) and may be comprised of a stretchable fabric. Middle layer 606 may be adhered to inner layer 602 and outer layer 608. Middle layer 606 may provide an adsorptive barrier to chemicals, such as tenor agent, Mustard gas, or other such agents. The adsorptive barrier in this layer may be comprised of carbon spheres which absorb the chemical agent before it reaches inner layer 602. Alternatively, the middle layer may be comprised of a blocking agent, such as gas tight sheets including Teflon (PTFE—polytetrafluoroethylene), PFA (perfluoroalkoxy polymer resin), or other such barrier polymers, films, or foils. Moreover, persons skilled in the art will appreciate that layer 606 may be formed from one or more individual layers, such as a combination of a layer of carbon spheres and a layer of a blocking agent. Outer layer 608 may be adhered to middle layer 606 and should be comprised of a fiber-product that has flame-resistant properties. An example of such a product is Dupont's NOMEX®.

In accordance with the principles disclosed herein, the use of at least two active layers in the fabric—i.e., the middle layer providing protection from bio-chemical hazards, with the outer, fire hazard protective layer—provide emergency personnel with a level of protection that was previously unavailable. Moreover, the composition 600 provides such protection without significantly compromising movement. The combination of the three layers described above in a hood, for example, provide the cranial region with protection against biological, chemical, radiological, nuclear, and fire hazards.

Persons skilled in the art will also appreciate that the composition 600 may be applicable to protecting other portions of the body instead of, or in addition to, the cranial region. For example, gloves may be constructed in accordance with the present invention having the three-layer structure described above (including the use of at least two active layers) that provide protection from biological, chemical, radiological, nuclear, and fire hazards simultaneously, while minimizing the negative impact on manual dexterity. Alternatively, the composition 600 may also be applied to foot under-garments as a replacement for, or in addition to, socks. Moreover, the composition 600 may also be applied to non-garment applications, such as blankets, that may be used by first-response personnel to cover and protect victims of such disasters as they are evacuated from the site.

As mentioned above, FIG. 7 depicts an alternative protective garment constructed according to the principles of the present invention and comprising a bodysuit 700. The bodysuit 700 generally comprises a body portion 702 and a hood portion 704, which may also be referred to as a frill. In one embodiment, the bodysuit 700 may be constructed of the multi-layered composition 600 depicted and described with reference to FIG. 6 above. In another embodiment, the bodysuit 700 is constructed of GORE™ CHEMPACK® Ultra Barrier fabric, which is commercially available from W.L. Gore & Associates, Inc. of Elkton, Md., USA. In further alternative embodiments, however, the bodysuit 700 may be constructed of any material or combination of materials equipped to provide protection against biological, chemical, radiological, nuclear, and/or fire hazards.

As depicted, the bodysuit 700 is equipped with a breathing apparatus 706, such as a self-contained breathing apparatus (SCBA), a combined SCBA and powered air-purifying apparatus (PAPR), or any other type of breathing apparatus. In one embodiment, the breathing apparatus comprises the Interspiro Spiromatic S3 and/or S5 self-contained breathing apparatus (SCBA), which are commercially available from Interspiro of Pleasant Prairie, Wis., USA. The breathing apparatus 706 more particularly comprises a mask 708 and a delivery line 710. The mask 708 is integrated with the hood portion 704 of the bodysuit 700. More specifically, in one embodiment, the hood portion 704 of the bodysuit 700 comprises a rubber membrane insert (not shown) that stretches over at least the lens of the mask 708 to provide a fluid-tight seal. The delivery line 710 fluidly couples the mask 708, and therefore, the hood portion 704, to a source of breathable air, which may, as mentioned above, comprise an SCBA, a combined SCBA and PAPR apparatus, or any other source of breathable air.

The body portion 702 of the bodysuit 700 is constructed as a single component having pant legs 712, arm sleeves 714, and torso region 716. Any seams inherent to the construction of the body portion 702 and/or the hood portion 704 are preferably stitched and sealed with a sealing tape or other known device. Additionally, in the depicted embodiment, the body portion 702 comprises integral booties 718 and gloves 720. In one embodiment, the pant legs 712 are also provided with an integral boot splash flap (not shown). The booties 718 comprise integral extensions of the pant legs 712 and are adapted to accommodate a wearer's feet. In one embodiment, the wearer would also wear external boots, such as rubber boots, over the booties 718, for added protection against biological, chemical, radiological, nuclear, and/or fire hazards, as well as rough terrain, debris, and physical harm.

Similar to the booties 718, one embodiment of the gloves 720 are integral extensions of the arm sleeves 714 of the bodysuit 700. In an alternative embodiment, however, the gloves 720 may be mechanically connected to the bodysuit 700 via a hard PVC glove ring and one or more rubber o-rings. In such a case, the arm sleeves 714 may further comprise rubber cuffs, or wrist seals, for providing a seal between the glove ring and one or more of the o-rings. The wearer may also wear additional gloves such as rubber, or fire-proof gloves, over the integral gloves 720, for added protection. In one embodiment, the additional outer gloves may preferably be constructed of NOMEX® and have a knit back and leather palm for comfort and function. The booties 718 and gloves 720 may be constructed of the same material or different material than the rest of the body portion 702 of the bodysuit 700. In either construction, both the booties 718 and gloves 720 are constructed of a material that is adapted to protect the wearer from biological, chemical, radiological, nuclear, and/or fire hazards. Additionally, in the event that the booties 718 and/or gloves 720 are constructed of a material different than the body portion 702 of the bodysuit 700, any seam between them and the bodysuit 700 are effectively sealed against penetration by biological, chemical, radiological, nuclear, and/or fire hazards with stitching and a sealing tape, or any other known device.

Figure 7:
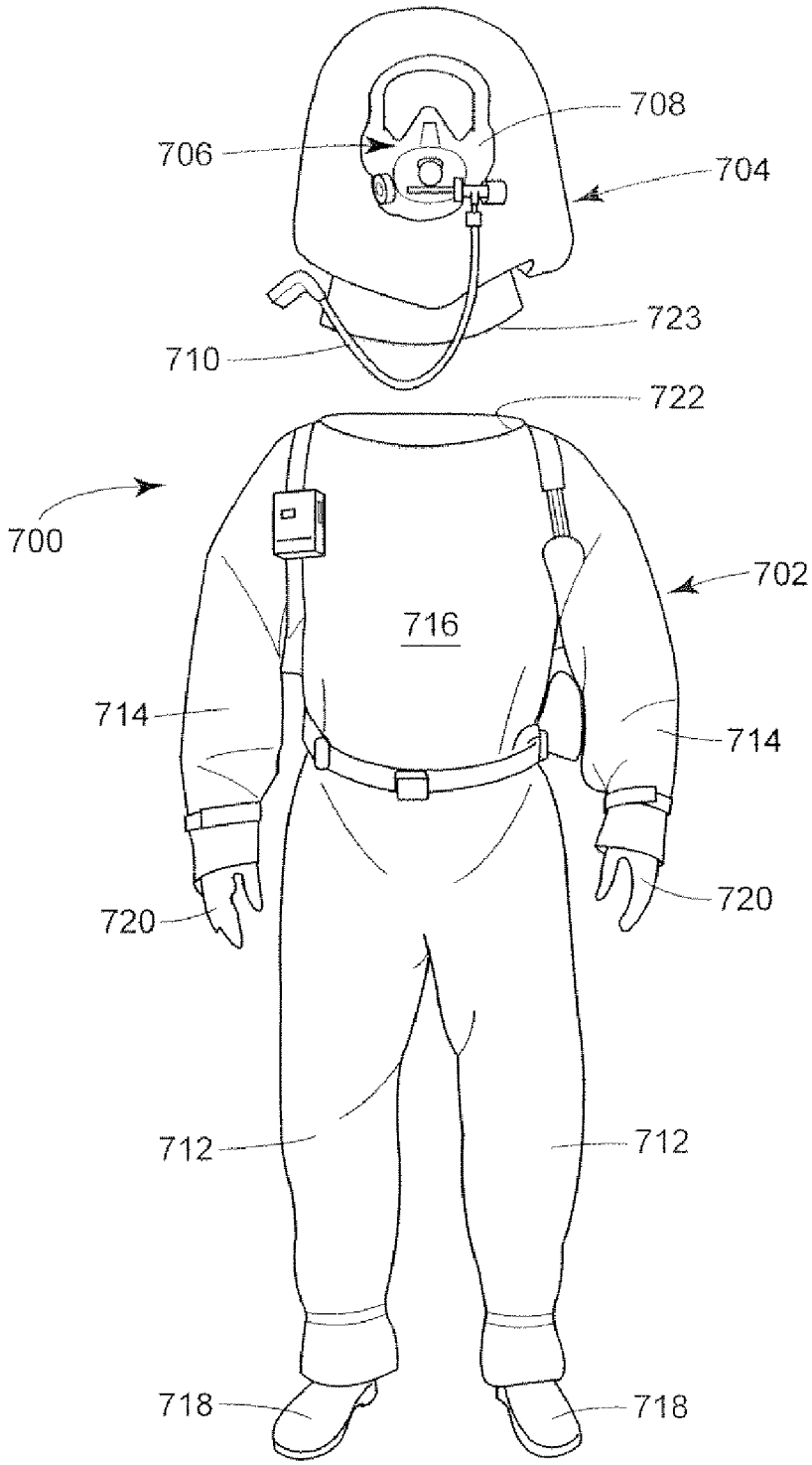
FIG. 7 shows an illustration of a partially exploded two-piece bodysuit that provides first-response personnel with protection from biological, chemical, radiological, nuclear, and fire hazards and which is constructed in accordance with one embodiment of the present invention.
Figure 8:
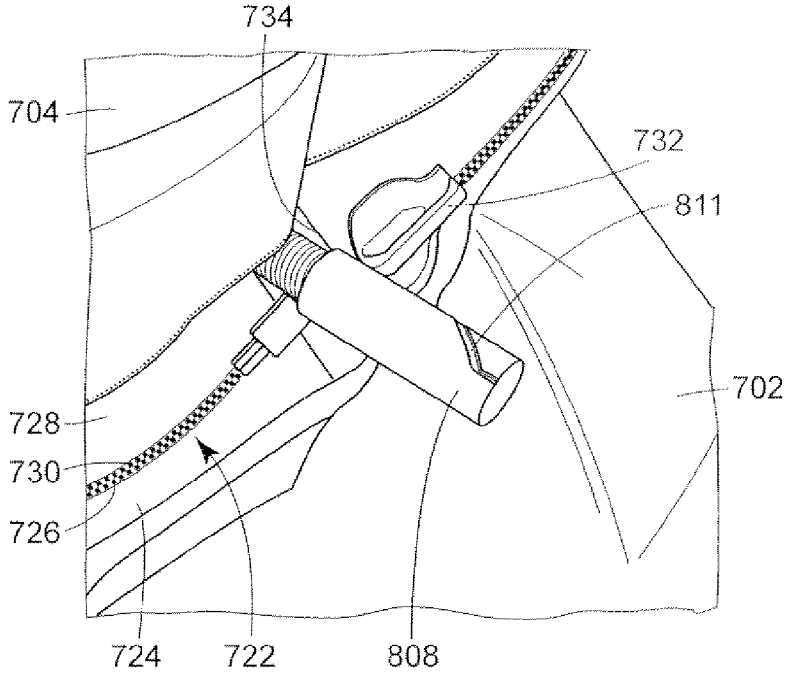
FIG. 8 shows a stem of a sealing apparatus disposed between a tape end and a slider of a zipper assembly of the bodysuit of FIG. 7, thereby illustrating an intermediate step of a donning process of the bodysuit.

As is further depicted in FIG. 7, the body portion 702 of the bodysuit 700 comprises an entry opening 722. The entry opening 722 is provided adjacent a shoulder region of the body portion 702 of the bodysuit 700 and enables a user to don the body portion 702. For example, the entry opening is sufficiently sized to enable first-response personnel to insert his/her body, up to the shoulders, into the body portion 702. Immediately adjacent the entry opening 722, the body portion 702 includes a first strip of zipper tape 724 comprising a first plurality of zipper teeth 726. The first zipper tape 724 and zipper teeth 726 are depicted in FIG. 8. The first zipper tape 724 and zipper teeth 726 are adapted to be releasably secured to a corresponding second strip of zipper tape 728 and a second plurality of zipper teeth 730, which are disposed along an opening 723 (shown in FIG. 7) of the hood portion 704 of the bodysuit 700 to removably secure the hood portion 704 to the body portion 702. To effectuate this securement, the hood portion 704 also includes a zipper slider 732 (shown in FIGS. 8 and 11) disposed on the second zipper tape 728. In a preferred embodiment of the bodysuit 700, the zipper tapes 724, 728, the teeth 726, 730, and the slider 732 cooperatively define a vapor-tight zipper assembly. In another embodiment, the body portion 702 further comprises a zipper splash flap (not shown) for extending over the secured vapor-tight zipper and hooking onto the hood with a hook and loop closure mechanism (not shown) to prevent materials from splashing directly onto the zipper components.

While donning the bodysuit 700, a user or other individual aligns the first and second zipper tapes 724, 728 and manipulates the slider 732 from one end of the zipper tapes 724, 728 to an opposite end of the zipper tapes 724, 728, in a known manner. This engages the corresponding first and second zipper teeth 726, 730, thereby securing the hood portion 704 to the body portion 702. With known zipper assemblies, however, the inherent design of the slider 732 and zipper tapes 724, 728 leaves a small opening 734 (shown in FIG. 8) between the nearly abutting ends of the zipper tapes 724, 728. This opening 734 may allow materials, gases, etc. to pass into and/or out of the bodysuit 700.

Figure 9:
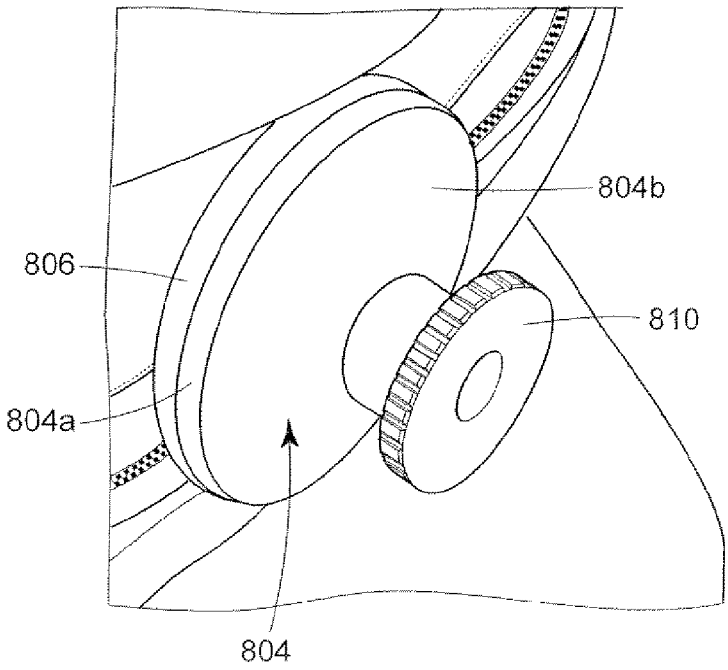
FIG. 9 shows a sealing apparatus completely secured to the bodysuit to thereby provide a fluid-tight seal between a tape end and a slider of the zipper assembly of the bodysuit of FIGS. 7 and 8.
Figure 10:
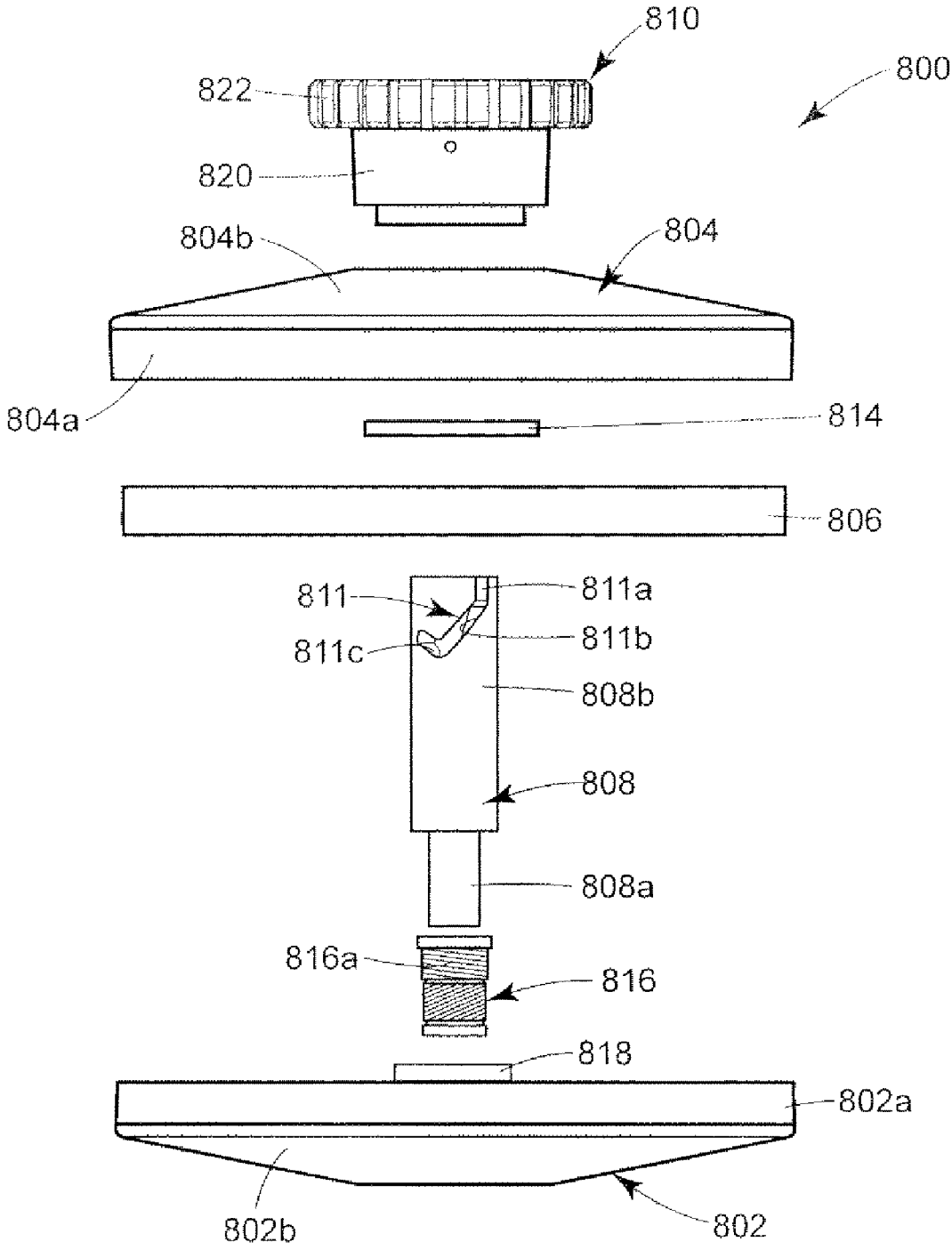
FIG. 10 shows an exploded side view of the sealing apparatus of FIGS. 8 and 9.
Figure 11:
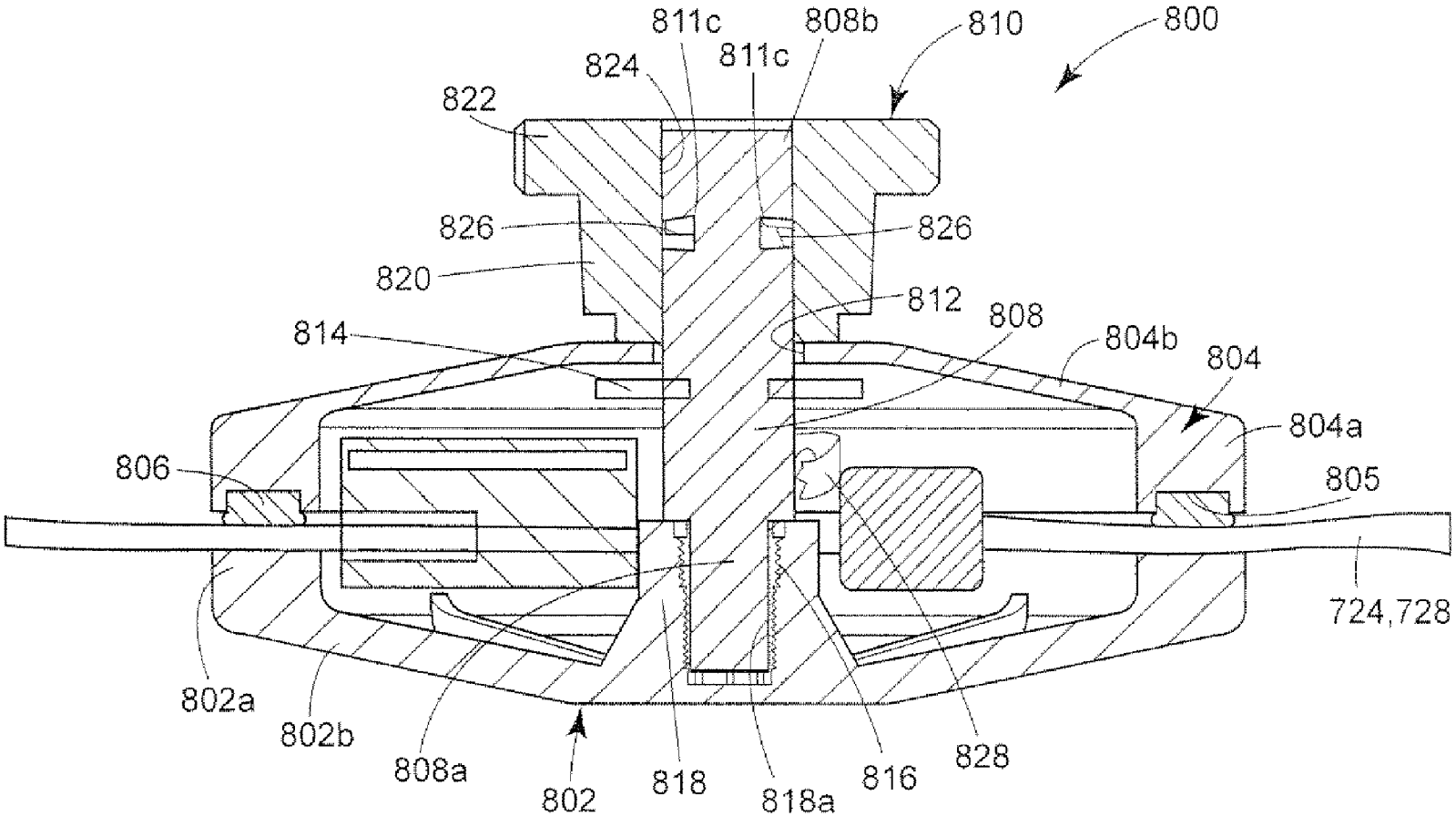
FIG. 11 shows a cross-sectional side view of the sealing apparatus of FIGS. 8-10.

Therefore, a sealing apparatus 800 is provided on the bodysuit 700, as depicted in FIG. 9 and described further with reference to FIGS. 10 and 11. Generally, with reference to FIG. 10, the sealing apparatus 800 comprises an inner shell 802, an outer shell 804, a gasket 806, a locking stem 808, and a knob 810. The locking stem 808 is fixed to the inner shell 802. The gasket 806 is fixed to the outer shell 804. Additional aspects of the sealing apparatus 800 will be described in further detail below.

During operation, the inner shell 802 is disposed within the bodysuit 700 adjacent the zipper tapes 724, 728 such that the locking stem 808 extends outward through the opening 734 defined between the ends of the zipper tapes 724, 728 and the slider 732, as depicted in FIG. 8. The outer shell 804 is then disposed on the locking stem 808 such that an end-most portion of the locking stem 808 passes through an aperture 812 (shown in FIG. 11) in the outer shell 804. Finally, the knob 810 is attached to the locking stem 808 such that the knob 810 and locking stem 808 compress the gasket 806, zipper tapes 724, 728, and adjacent aspects of the body and hood portions 702, 704 of the bodysuit 700 between the inner and outer shells 802, 804, as depicted in FIGS. 9 and 11. This compression seals the opening 734 off from the atmosphere, thereby preventing any materials, gases, etc. from passing into ad/or out of the opening 734 in the bodysuit 700.

As stated, the sealing apparatus 800 generally comprises the inner shell 802, the outer shell 804, the gasket 806, the locking stem 808, and the knob 810. Additionally, the sealing apparatus 800 comprises a rubber washer 814 and a threaded insert 816, as depicted in FIGS. 10 and 11.

The inner shell 802 is a generally rigid, plastic component comprising an outer ring portion 802*a* and a central portion 802*b*. As shown in FIG. 11, the central portion 802 is generally frustoconical and includes a cylindrical boss 818, which defines a bore 818*a*. Similarly, the outer shell 804 is a generally rigid, plastic component comprising an outer ring portion 804*a* and a central portion 804*b*. The central portion 804*b* of the outer shell 804 is also generally frustoconical and defines the aperture 812, as mentioned above. The outer ring portion 804*a* of the outer shell 804 defines a circular recess 805, which has a generally rectangular cross-section.

The gasket 806 comprises a rubber gasket and is sized and dimensioned to be disposed in the recess 805 in the outer shell 804. In one embodiment, the gasket 806 may be fixed within the recess 805 with an adhesive such as a cyanoacrylate adhesive or Loctite®, which is commercially available from the Henkel Corp, of Rocky Hill, Conn., USA. In other embodiments, the gasket 806 may be fixed within the recess 805 with mere friction. The rubber washer 814 is disposed on the locking stem 808 adjacent to the aperture 812 in the outer shell 804, as depicted in FIG. 11. In one embodiment, the rubber washer 814 may be fixed to the outer shell 804 with an adhesive such as a cyanoacrylate adhesive or Loctite®.

The locking stem 808 comprises an elongated metal rod having a reduced diameter portion 808*a* and a head portion 808*b*. The reduced diameter portion 808*a* is solid. The head portion 808*b* is hollow and defines a pair of locking slots 811. As shown in FIG. 10, the locking slots 811 of the disclosed embodiment are generally J-shaped comprising a first entry portion 811*a*, a transition portion 811*b*, and a locking portion 811*c*. In an alternative embodiment, the locking stem 808 may be wholly solid and the locking slots 811 may comprise recesses in the head portion 808b. The operation of the locking slots 811 will be described below.

The threaded insert 816 comprises a generally cylindrical member adapted to couple the locking stem 808 to the inner shell 802. More specifically, the disclosed threaded insert 816 is adapted to receive the reduced diameter portion 808*a* of the locking stem 808, as depicted in FIG. 11, for example. In one embodiment, the threaded insert 816 is adhered to the reduced diameter portion 808*a* with an adhesive such as a cyanoacrylate adhesive or Loctite. Moreover, as is depicted in FIG. 10, for example, the threaded insert 816 includes an outer threaded surface 816*a*. Accordingly, the threaded insert 816 is threadably disposed within the bore 818*a* defined by the cylindrical boss 818 formed on the inner shell 802, as depicted in FIG. 11. The outer threaded surface 816*a* therefore engages the surface inside of the cylindrical bore 818*a* to secure the threaded insert 816 within the cylindrical boss 818, thereby securing the locking stem 808 to the inner shell 802. In one embodiment, the threaded insert 816 is additionally or supplementally fixed within the cylindrical boss 818 via a sonic welding process. In another embodiment, the bore 818*a* in the boss 818 may also include threads. In still another embodiment, the sealing apparatus 800 may not include the threaded insert 816 at all, but rather, the locking stem 808 may be secured directly within the bore 818*a* in the inner shell 802 with an adhesive, or any other means.

As mentioned above, the sealing apparatus lastly comprises the knob 810. The knob 810, as depicted in FIGS. 10 and 11, generally comprises a central cylinder portion 820 and a hand-wheel 822. The hand-wheel 822 is larger in diameter than the central cylinder portion 820 and includes a ribbed external surface for easy grasping by a user. The central cylinder portion 820 defines an inner cylindrical bore 824 for receiving the head portion 808*b* of the locking stem 808, as depicted in FIG. 11. Additionally, the central cylinder portion 820 of the knob 810 comprises a pair of locking pins 826. The locking pins 826 extend radially inward from the surface of the inner cylindrical bore 824. The locking pins 826 are adapted to slidingly engage the locking slots 811 formed in the head portion 808*b* of the locking stem 808.

For example, while assembling the sealing apparatus 800 onto the bodysuit 700, as generally described above, a user first positions the inner shell 802 adjacent the opening 734 between the ends of the zipper tapes 724, 728 such that the locking stem 808 extends therethrough, as depicted in FIG. 9. Next, the user positions the outer shell 804 onto the locking stem 808, such that the head portion 808*b* of the locking stem 808 extends through the aperture 812 of the outer shell 804. Additionally, the rubber washer 814, which is fixed to the outer shell 804, frictionally engages locking stem 808 to provide a fluid-tight seal therebetween.

With the outer shell 804 so positioned, the knob 810 is positioned onto the head portion 808*b* of the locking stem 808 such that the locking pins 826 corresponding slide into the entry portions 811*a* of the locking slots 811. As the user continues to push the knob 810 onto the locking stem 808, the locking pins 826 slide passed the entry portions 811*a* of the locking slots 811, through the transition portions 811*b*, and finally into the locking portions 811*c*. As this occurs, the knob 810 rotates according to the angle of the transition portions 811*b* relative to the entry portions 811*a*, and then according to the angle of the locking portions 811. Simultaneously, this action compresses the inner and outer shells 802, 804 together and into the position depicted in FIG. 9. More particularly, this compresses the outer ring portions 802*a*, 804*a* of the inner and outer shells 802, 804, respectively, together.

For example, as illustrated in FIG. 11, upon the locking pins 826 reaching the locking portions 811*c* of the locking slots 811, the central cylinder portion 820 of the knob 810 engages the outer shell 804, thereby applying a force toward the inner shell 802. Meanwhile, the locking pins 826 engage the locking portions 811*c* of the locking slots 811 to apply a force to the locking stem 808, and therefore the inner shell 802, toward the outer shell 804. To release the sealing apparatus 800 from the bodysuit 700, the user simply grasps the knob 810 and rotates it relative to the outer shell 804 such that the pins disengage the locking portions 811*c* of the locking slots 811, slide up through the transition portions 811*b*, and out passed the entry portions 811*a* such that the knob 810 disengages the locking stem 808. Thereafter, the outer shell 804 may be removed from the locking stem 808 and the entire sealing apparatus 800 removed from the bodysuit 700.

While the locking stem 808 has been described herein as comprising the locking slots 811 and the knob 810 comprising the locking pins 826, an alternative embodiment may include the knob 810 comprising the locking slots 811 and the locking stem 808 comprising the locking pins 826. In another embodiment, the sealing apparatus 800 may not include locking slots 811 and locking pins 826 at all, but rather, any other device capable of securing the inner and outer shells 802, 804 together in accordance with the principles of the present disclosure. For example, in one alternative embodiment, the knob 810 and the locking stem 808 may be releasably secured together with a threaded engagement, or a spring-detent device, or any other foreseeable device.

While the sealing apparatus 800 has been described thus far as being wholly independent of the bodysuit 700, an alternative embodiment of the bodysuit 700 may provide for a securement device 828 that helps incorporate the sealing apparatus 800 to the bodysuit 700 For example, FIG. 11 illustrates one embodiment of a securement device 828 that comprises a strap. The strap or securement device 828 illustrated in FIG. 11 is fixedly attached to the bodysuit 700 and extends around the locking stem 808 of the sealing apparatus 800, thereby ensuring that the sealing apparatus 800 is readily positioned to be secured adjacent the opening 734 formed between the ends of the zipper tapes 724, 728 while a user is attaching the hood portion 704 to the body portion 702. In one embodiment, the strap or securement device 828 may comprise an extension of one or both of the zipper tapes 724, 728.

It should be appreciated that the sealing apparatus 800 has been described herein as comprising multiple components secured to together by various means, it should be appreciated that various components may be formed integrally. For example, in an alternative embodiment, the locking stem 808 and the inner shell 802 may be constructed as a single, integral component via injection molding, casting, or some other manufacturing process.

Further, while the inner and outer shells 802, 804 have been disclosed herein as including central portions 802*a*, 804*a* that are generally frustoconical, such central portions 802*a*, 804 may be shaped in generally any manner capable of accomplishing the principles of the present disclosure. For example, in one alternative embodiment, the central portions 802*a*, 804*a* of the inner and outer shells 802, 804 may be shaped as hollow hemispheres, or hollow cones.

Further yet, while the sealing apparatus 800 has been described herein as being applied to seal the opening 734 inherently present between nearly abutting ends of a zipper that attaches the hood portion 704 to the body portion 702 of the bodysuit 700, the sealing apparatus 800 could be used to seal an opening between zipper ends connecting any two portions of an alternative bodysuit having other removable portions, or may even be used to simply seals tears, holes, or other defects in such a bodysuit.

Accordingly, in light of the foregoing, it should be appreciated that the present disclosure merely provides examples of the invention. The invention is not intended to be limited to the examples that are disclosed herein, but rather, the invention is to be defined as anything that falls within the spirit and scope of the following claims.

What is claimed:

1. A protective bodysuit, comprising:

a body portion;

a hood portion adapted to be selectively secured to the body portion along an interface, the body portion and the hood portion being constructed of a material comprising:

an inner layer;

a middle layer adhered to said inner layer, the middle layer comprising members that act as a barrier; and an outer layer adhered to said middle layer, the outer layer comprising a flame resistant fiber-product; and a sealing apparatus for sealing an opening defined between opposing ends of a securement device that connects two or more portions of the protective bodysuit, the sealing apparatus comprising:

a first clam shell component;

a second clam shell component defining an aperture;

a locking stem extending from the first clam shell component and through the aperture in the second clam shell component; and a knob releasably engaging the locking stem adjacent the aperture in the second clam shell component, thereby compressing the first and second clam shell components together.

2. The protective bodysuit of claim 1, further comprising a protective mask, wherein said hood portion is integrated with said protective mask via a sealed interface to provide fully-encapsulated protection.

3. The protective bodysuit of claim 1, wherein said body portion comprises pant legs and arm sleeves.

4. The protective bodysuit of claim 3, wherein said body portion further comprises booties and gloves.

5. The protective bodysuit of claim 1, wherein said members of said middle layer comprise at least one of a chemical barrier and a biological barrier.

6. The protective bodysuit of claim 1, wherein said members of said middle layer comprise spherical adsorber members.

7. The protective bodysuit of claim 1, wherein said members of said middle layer comprise a blocking agent.

8. The protective bodysuit of claim 1, wherein said middle layer comprises a first middle layer and a second middle layer.

9. A protective bodysuit, comprising:

a body;

a hood adapted to be selectively attached to said body along an interface;

a securement device having a first component fixed to the hood and a second component fixed to the body, the first and second components adapted to be selectively secured together to provide a first seal at a first portion of the interface between the hood and the body; and a sealing apparatus adapted to be coupled to portions of at least one of the body, the hood, and the securement device to provide a second seal at a second portion of the interface between the hood and the body such that the securement device and the sealing apparatus completely seal the interface;

wherein the sealing apparatus comprises:

a first clam shell component;

a second clam shell component defining an aperture;

a locking stem extending from the first clam shell component and through the aperture in the second clam shell component; and a knob releasably engaging the locking stem adjacent the aperture in the second clam shell component, thereby compressing the first and second clam shell components together.

10. The multi-layer garment of claim 9, wherein:

said first middle layer comprises adsorber members; and said second middle layer comprises a blocking agent.

11. The protective body suit of claim 9, wherein the securement device comprises a zipper.

12. The protective body suit of claim 9, wherein the first and second clam shell components are compressed together around the second portion of the interface.

13. The protective body suit of claim 12, wherein the locking stem releasably locks the clam shell components to the bodysuit.

14. The protective body suit of claim 13, wherein the first clam shell component is adapted to be disposed inside of the bodysuit, the second clam shell component is adapted to be disposed outside of the bodysuit, and the locking stem extends from the inside to the outside of the bodysuit through an opening defined at the second portion of the interface.

15. The protective bodysuit of claim 10, wherein the body and hood are constructed of a material comprising:

an inner layer;

a middle layer adhered to said inner layer, the middle layer comprising members that act as a barrier; and an outer layer adhered to said middle layer, the outer layer comprising a flame resistant fiber-product.

16. The protective bodysuit of claim 15, wherein said members of said middle layer comprise at least one of a chemical barrier and a biological barrier.

17. The protective bodysuit of claim 15, wherein said members of said middle layer comprise spherical adsorber members.

18. The protective bodysuit of claim 15, wherein said members of said middle layer comprise a blocking agent.

19. The protective bodysuit of claim 15, wherein said middle layer comprises a first middle layer and a second middle layer.

20. The multi-layer garment of claim 19, wherein:

said first middle layer comprises adsorber members; and said second middle layer comprises a blocking agent.

21. A sealing apparatus for sealing an opening defined between opposing ends of a zipper that connects two or more portions of a protective bodysuit, the sealing apparatus comprising:

a first clam shell component;

a second clam shell component defining an aperture;

a locking stem extending from the first clam shell component and through the aperture in the second clam shell component; and a knob releasably engaging the locking stem adjacent the aperture in the second clam shell component, thereby compressing the first and second clam shell components together.

22. The sealing apparatus of claim 21, further comprising a gasket disposed between the first and second clam shell components.

23. The sealing apparatus of claim 21, wherein one of the locking stem and the knob comprises a locking slot and the other of the locking stem and the knob comprises a locking pin adapted to be inserted into the locking slot.

24. The sealing apparatus of claim 21, wherein the locking slot comprises an entry portion, an transition portion, and a locking portion, which combine to define a generally J-shaped slot.

25. A protective ensemble, comprising:

a body portion;

a hood portion adapted to be selectively attached to the body portion along a circular interface;

a zipper having a first zipper portion attached to the body portion and a second zipper portion attached to the hood portion, the zipper adapted to releasably secure the hood portion to the body portion along the interface;

a first clam shell component comprising a first shell and a locking stem, the first shell adapted to be disposed adjacent an opening in the interface and the locking stem adapted to extend through the opening in the interface;

a second clam shell component comprising a second shell defining an aperture, the aperture in the second shell adapted to receive the locking stem such that a portion of the interface located adjacent the opening is disposed between the first and second shells; and a knob adapted to engage the locking stem and the second shell to compress the first and second clam shell components together.

26. The protective ensemble of claim 25, wherein one of the locking stem and the knob comprises locking slots for receiving locking pins disposed on the other of the locking stem and the knob.

27. The protective ensemble of claim 25, further comprising a gasket fixed to one of the first and second clam shell components and adapted to engage the portion of the interface adjacent to the opening in the interface.

* * * * *